US006587654B1

(12) United States Patent
Nishi

(10) Patent No.: US 6,587,654 B1
(45) Date of Patent: Jul. 1, 2003

(54) IMAGE FORMING APPARATUS

(75) Inventor: Takayuki Nishi, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/036,458

(22) Filed: Jan. 7, 2002

(51) Int. Cl.[7] ..... G03G 15/20
(52) U.S. Cl. ..... 399/67; 399/69; 399/328
(58) Field of Search ..... 399/49, 67, 69, 399/70, 328, 330; 219/216, 619

(56) References Cited

U.S. PATENT DOCUMENTS 5,049,906 A * 9/1991 Kobayashi et al. ..... 399/67 X
5,568,229 A * 10/1996 Szlucha ..... 399/67 X
5,905,925 A * 5/1999 Kawabata et al. ..... 399/67 X
6,087,641 A * 7/2000 Kikouchi et al. ..... 219/619
6,115,563 A * 9/2000 Miyamoto ..... 399/67
6,148,163 A * 11/2000 Ito ..... 399/67
6,336,009 B1 * 1/2002 Suzumi et al. ..... 399/67

FOREIGN PATENT DOCUMENTS

JP 3-33782 2/1991
JP 8-16006 1/1996
JP 8-248795 9/1996

* cited by examiner

*Primary Examiner*—Hoan Tran
(74) *Attorney, Agent, or Firm*—Foley & Lardner

(57) ABSTRACT

Whether a fixing process is necessary or not for each of the areas corresponding to portions of a heat roller respectively heated by a plurality of heaters contained in the heat roller is determined based on the image to be fixed on an image-forming medium. Preset electric power is supplied only to the heater corresponding to the area which is determined to require the fixing process so as to set the corresponding portion of the heat roller to a fixing temperature.

20 Claims, 9 Drawing Sheets

IMAGE FORMING APPARATUS

BACKGROUND OF THE INVENTION

This invention relates to an image forming apparatus such as a digital copying machine which includes a fixing device having contained therein a heat generating member heated by an induction heating device using a coil, for example.

Conventionally, in an image forming apparatus such as a digital copying machine, a fixing device which fixes a developer image on paper is used. The fixing device of the digital copying machine includes a heating roller and a pressure roller which is placed in contact with the heating roller. The fixing device fixes a developer image on a sheet of paper by use of heat of the heating roller while inserting the sheet of paper in between the heating roller and the pressure roller and feeding the same.

As one example of the heat source of the heating roller, an induction heating device is provided. In the fixing device used in the conventional digital copying machine, an induction heating device which heats the whole portion of the heating roller is used. However, in the above fixing device, it is necessary to heat the whole portion of the heating roller even when an image is present only on part of the sheet of paper, that is, when a developer exists only on part of the sheet of paper. Therefore, electric power tends to be wasted.

BRIEF SUMMARY OF THE INVENTION

This invention is made to solve a problem that electric power tends to be wasted when an image is present only on part of the sheet of paper as described above, and an object of this invention is to provide a fixing device and an image forming apparatus in which a fixing process can be efficiently performed without wasting electric power.

A fixing device of this invention which fixes a to-be-fixed agent on an image-forming medium comprises a heat roller which has a plurality of heaters contained therein and corresponding portions of which are heated by selectively supplying electric power to the heaters, an image area determining section which determines whether a fixing process is necessary or not for each of areas corresponding to the portions of the heat roller respectively heated by the heaters based on an image to be fixed on the image-forming medium, and a fixing control section which supplies preset electric power only to the heater corresponding to the area which is determined to require the fixing process by the image area determining section to set the corresponding portion on the heat roller to a fixing temperature and fixes the to-be-fixed agent on the image-forming medium when the portion on the heat roller corresponding to the heater supplied with the preset electric power has reached a preset fixing temperature.

An image forming apparatus of this invention which forms an image on an image-forming medium by use of a developer comprises an image input section which inputs image data, an optical unit which applies light to an image carrier to expose the image carrier to light according to image data input by the image input section, a transferring section which transfers a developer image corresponding to an electrostatic latent image formed on the image carrier by applying light thereto by the optical unit onto the image-forming medium, a fixing device including a heat roller which has a plurality of heaters contained therein and corresponding portions of which are heated by selectively supplying electric power to the heaters, an image area determining section which determines whether a fixing process is necessary or not for each of areas corresponding to the portions of the heat roller respectively heated by the heaters based on image data input by the image input section, a heater control section which supplies preset electric power only to the heater corresponding to the area which is determined to require the fixing process by the image area determining section to set the corresponding portion on the heat roller to a fixing temperature, and a printing control section which feeds the image-forming medium having the developer image transferred thereon by the transferring section to the fixing device and fixes the to-be-fixed agent on the image-forming medium by use of the heat roller when the portion on the heat roller corresponding to the heater supplied with the electric power by the heater control section has reached a preset fixing temperature.

A fixing device of this invention which fixes a to-be-fixed agent on an image-forming medium comprises heating means which has a plurality of heaters contained therein and corresponding portions of which are heated by selectively supplying electric power to the heaters, image area determining means for determining whether a fixing process is necessary or not for each of the areas corresponding to the portions on the heating means respectively heated by the heaters based on an image to be fixed on the image-forming medium, and fixing control means for supplying preset electric power only to the heater corresponding to the area which is determined to require the fixing process by the image area determining means to set the corresponding portion on the heating means to a fixing temperature and fixes the to-be-fixed agent on the image-forming medium when the portion on the heating means corresponding to the heater supplied with the preset electric power has reached a preset fixing temperature.

An image forming apparatus of this invention which forms an image on an image-forming medium by use of a developer comprises image input means for inputting image data, optical control means for applying light to an image carrier to expose the image carrier to light according to image data input by the image input means, transferring means for transferring a developer image corresponding to an electrostatic latent image formed on the image carrier by applying light thereto by the optical control means onto the image-forming medium, fixing means including a heat roller which has a plurality of heaters contained therein and corresponding portions of which are heated by selectively supplying electric power to the heaters, image area determining means for determining whether a fixing process is necessary or not for each of the areas corresponding to the portions on the heat roller respectively heated by the heaters based on image data input by the image input means, heater control means for supplying preset electric power only to the heater corresponding to the area which is determined to require the fixing process by the image area determining means to set the corresponding portion on the heat roller to a fixing temperature, and printing control means for feeding the image-forming medium having the developer image transferred thereon by the transferring means to the fixing means and fixing the to-be-fixed agent on the image-forming medium by use of the heat roller when the portion on the heat roller corresponding to the heater supplied with the electric power by the heater control means has reached a preset fixing temperature.

A fixing method of this invention used in a fixing device including a heat roller which has a plurality of heaters contained therein and corresponding portions of which are heated by selectively supplying electric power to the heaters comprises determining whether a fixing process is necessary or not for each of areas corresponding to the portions on the heat roller respectively heated by the heaters based on an image to be fixed on an image-forming medium, supplying preset electric power only to the heater corresponding to the area which is determined to require the fixing process by the determining step to set the corresponding portion on the heating means to a fixing temperature, and fixing the to-be-fixed agent on the image-forming medium when the portion on the heat roller corresponding to the heater supplied with the preset electric power has reached a preset fixing temperature.

An image forming method of this invention used in an image forming apparatus using a fixing device including a heat roller which has a plurality of heaters contained therein and corresponding portions of which are heated by selectively supplying electric power to the heaters comprises inputting image data, applying laser light to an image carrier to expose the image carrier to light according to the input image data, transferring a developer image corresponding to an electrostatic latent image formed on the image carrier onto the image-forming medium, determining whether a fixing process is necessary or not for each of the areas corresponding to the portions on the heat roller respectively heated by the heaters based on the input image data, supplying preset electric power only to the heater corresponding to the area which is determined to require the fixing process by the determining step to set the corresponding portion on the heat roller to a fixing temperature, and feeding the image-forming medium having the developer image transferred thereon and fixing the to-be-fixed agent on the image-forming medium when the portion on the heat roller corresponding to the heater supplied with the electric power has reached a preset fixing temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

There will now be described an embodiment of this invention with reference to the accompanying drawings.

Figure 1:
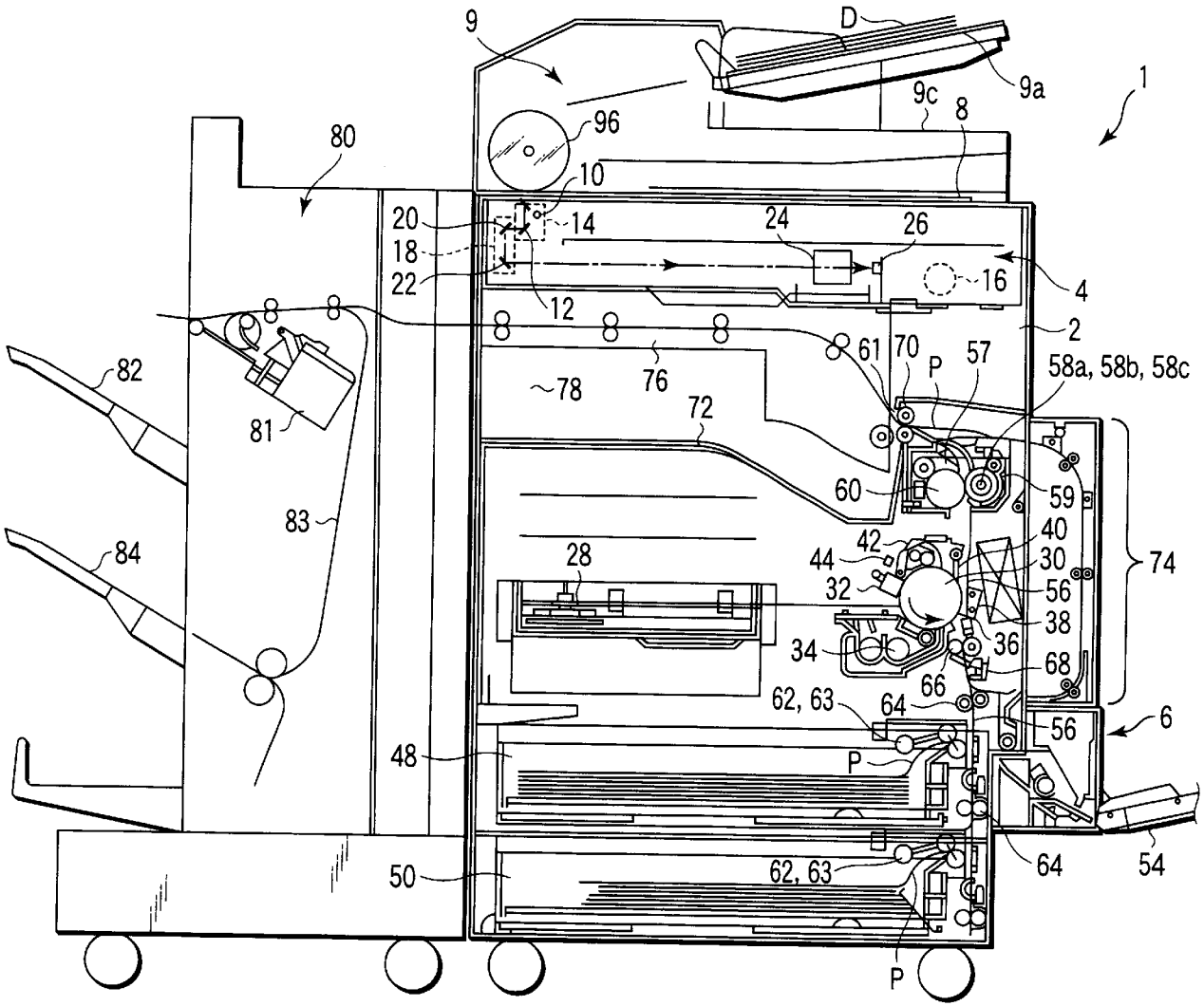
FIG. 1 is a cross-sectional view showing the schematic configuration of a digital copying machine used as an image forming apparatus which includes a fixing device according to an embodiment of this invention.

FIG. 1 is a cross-sectional view showing the schematic configuration of a digital copying machine used as an image forming apparatus which includes a fixing device according to an embodiment of this invention.

As shown in FIG. 1, a digital copying machine 1 includes an apparatus main body 2, and a scanner section 4 used as reading means and a printer section 6 functioning as image forming means are provided in the apparatus main body 2.

On the upper surface of the apparatus main body 2, a document table 8 formed of a transparent glass plate on which a to-be-read object, that is, a document D is placed is provided. Further, on the upper surface of the apparatus main body 2, an automatic document feeder 9 (which is hereinafter referred to as an ADF) used as feeding means for automatically feeding the document D onto the document table 8 is arranged.

The document D placed on a document tray 9*a* of the ADF 9 is fed by use of a feed guide (not shown) and discharged onto a paper discharging tray 9*c* via a platen roller 9*b*. An image of the document D is read by exposing and scanning the document by use of an exposure lamp 10 of the scanner section 4 which will be described later while the document D is being fed by the platen roller 9*b*.

The documents D are placed on the document tray 9*a* of the ADF 9 with the to-be-read surface up and are sequentially fetched one by one from the top document.

The scanner section 4 disposed in the apparatus main body 2 includes the exposure lamp 10 configured by, for example, a halogen lamp as a light source used to illuminate the document D placed on the document table 8 or the document D fed by the ADF 9 and a first mirror 12 which deflects reflected light from the document D in a preset direction. The exposure lamp 10 and first mirror 12 are mounted on a first carriage 14 disposed below the document table 8.

The first carriage 14 is disposed to be movable in parallel to the document table 8 and is reciprocally moved below the document table 8 by a scanner motor (driving motor) 16 via a toothed belt (not shown) or the like. The scanner motor 16 is configured by a stepping motor or the like.

Below the document table 8, a second carriage 18 which is movable parallel to the document table 8 is disposed. On the second carriage 18, second and third mirrors 20, 22 which sequentially deflect light reflected from the document D and deflected by the first mirror 12 are mounted at right angles. Rotation force from the scanner motor 16 is transmitted to the second carriage 18 via the toothed belt or the like which drives the first carriage 14 so that the second carriage will follow the first carriage 14 and can be moved parallel to the document table 8 at a speed which is half the speed of the first carriage 14.

Further, below the document table 8, an image forming lens 24 which focuses the reflected light from the third mirror 20 on the second carriage 18 and a CCD sensor (line sensor) 26 which receives the reflected light focused by the image forming lens 24 and photoelectrically converts the received light are disposed. The image forming lens 24 is disposed to be movable by use of a driving mechanism in a plane which contains an optical axis of light deflected by the third mirror 22 and is moved to form an image with a desired magnification (in the main scanning direction) by focusing the reflected light. The CCD sensor 26 photoelectrically converts the reflected light which is made incident according to an image processing clock supplied from a main CPU which will be described later and outputs an electrical signal corresponding to the read image of the document D. The magnification in the sub-scanning direction is adjusted by changing the feeding speed by the ADF 9 or the moving speed of the first carriage 14.

The illumination position by the exposure lamp 10 is fixed in a reading position (not shown) when the document D fed by the ADF 9 is read. Further, the illumination position by the exposure lamp 10 is moved from the left position to the right position along the document table 8 when the document D placed on the document table 8 is read.

On the other hand, the printer section 6 includes a laser exposure device 28 functioning as latent image forming means. An electrostatic latent image is formed on the outer surface of a photosensitive drum 30 by scanning the outer surface of the photosensitive drum 30 by use of laser light from the laser exposure device 28.

Further, the printer section 6 includes the photosensitive drum 30, which is disposed in substantially the central right portion of the apparatus main body 2 and is freely rotatably, provided as the image carrier and the outer surface of the photosensitive drum 30 is exposed by laser light from the laser exposure device 28 to form a desired electrostatic latent image thereon. Around the outer surface of the photosensitive drum 30, an electric charger 32 which charges the outer surface of the drum to a preset potential, a developing unit 34 used as developing means which supplies toner as a developer to the electrostatic latent image formed on the outer surface of the photosensitive drum 30 to develop the image with a desired image density, a transfer charger 38 which has a separation charger 36 integrally formed therewith to separate an image-forming medium, that is, copy paper P supplied from one of cassettes 48, 50 as will be described later from the photosensitive drum 30 and transfers a toner image formed on the photo-sensitive drum 30 onto the copy paper P, a separation claw 40 which strips the copy paper P from the outer surface of the photosensitive drum 30, a cleaning unit 42 which removes toner remaining on the outer surface of the photosensitive drum 30 and a discharging unit 44 which discharges the outer surface of the photosensitive drum 30 are arranged in this order.

In the lower portion of the apparatus main body 2, the upper-level cassette 48 and lower-level cassette 50 which can be withdrawn from the apparatus main body are arranged in a stacked form and sheets of copy paper P of different sizes are loaded in the respective cassettes 48, 50. A tray 44 for manual paper-feeding is provided beside the upper-level cassette 48.

In the apparatus main body 2, a feeding path 56 which extends from each of the cassettes 48, 50 through a transferring section lying between the photosensitive drum 30 and the transfer charger 38 is formed and a fixing device 57 is provided at the end of the feeding path 56. A paper discharging port 61 is formed above the fixing device 57.

The fixing device 57 includes a heating roller 59 having contained therein three induction heaters (IH) 58 (58*a*, 58*b*, 58*c*) used as a heat source and a pressure roller 60. The fixing device fixes a developer image on the copy paper P by use of heat of the heating roller 59 while the copy paper P is inserted in between the heating roller and the pressure roller and fed. The copy paper P having passed through the fixing device 57 is discharged via the paper discharging port 61 by means of a paper discharging roller pair 70.

Each set of a paper feeding roller 62 and separation roller 63 which take out sheets of copy paper P one by one from a corresponding one of the cassettes 48, 50 is provided near the corresponding one of the cassettes 48, 50. Further, a large number of paper feeding roller pairs 64 which feed the copy paper P taken out by the paper feeding roller 62 and separation roller 63 along the feeding path 56 are provided along the feeding path 56.

A resist roller pair 66 is provided on the upstream side of the feeding path 56 from the photosensitive drum 30. The resist roller pair 66 corrects the inclination of the copy paper P taken out, aligns the front end of the toner image on the photosensitive drum 30 with the front end of the copy paper P and feeds the copy paper P to the transferring section at the same speed as the moving speed of the outer surface of the photosensitive drum 30. In front of the resist roller pair 66, that is, on the paper feeding roller 64 side, a prior-to-aligning sensor 68 which is used to detect arrival of the copy paper P is provided.

One of the sheets of copy paper P taken out one by one from a corresponding one of the cassettes 48, 50 by the paper feeding roller 62 is fed to the resist roller pair 66 by the paper feeding roller pairs 64. Then, the front end of the copy paper P is aligned by the resist roller pair 66 and the copy paper is fed to the transferring section.

In the transferring section, the developer image or toner image formed on the photosensitive drum 30 is transferred onto the paper P by the transfer charger 38. The copy paper P having the toner image transferred thereon is separated from the outer surface of the photosensitive drum 30 by the action of the separation charger 36 and separation claw 40 and fed to the fixing device 57 via a conveyor belt (not shown) configuring part of the feeding path 56. Then, after the developer image is melted and fixed on the copy paper P by the fixing device 57, the copy paper P is discharged onto a paper discharging tray 72 in the apparatus main body 2 via the paper discharging port 61 by the paper discharging roller pair 70.

An automatic double-face setting device 74 which reverses the copy paper P having passed through the fixing device 57 and feeds the same to the feeding path 56 again is provided on the right side of the feeding path 56.

Further, on the front upper portion of the apparatus main body 2, an operation panel which is used to specify the copying start and various copying conditions such as copy magnification is provided.

In the digital copying machine 1, an ADF function, finisher function, FAX function, printer function, DSS (double-sided-setting) function, and the like can be set as optional functions (devices). As the ADF function, a preferential input process in which only a read input is preferentially made can be performed. The ADF (automatic document feeder 9) is mounted on the document table and connected to the main body.

The finisher function is disposed on the side portion of the apparatus main body and connected to the main body.

The FAX function permits the function to be added by loading a FAX board on the mother board of a control circuit.

The printer function permits the function to be added by loading a printer FAX board on the mother board of the control circuit.

The DSS (double-sided-setting) function permits the function to be added by additionally providing a DSS controller on the control circuit.

Each of the above functions can be previously registered in a memory, hard disk or the like at the time of addition of the function, or it is possible to determine an optional connection (setting) state based on a response obtained after making an inquiry to each section at the time of turning the power supply or determine the same based on the state of the switches of the board.

Figure 2:
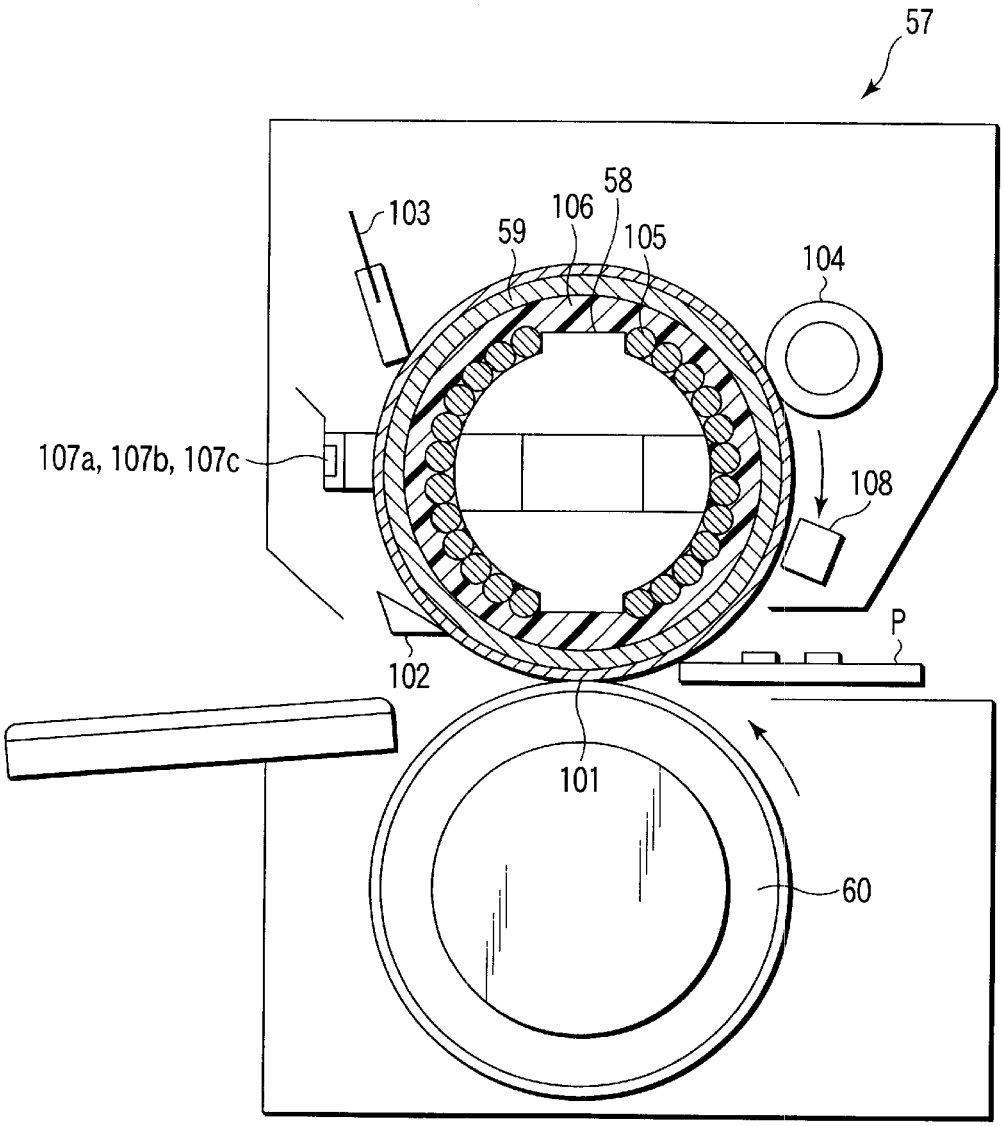
FIG. 2 is a view for illustrating the shape of a coil incorporated in the fixing device.

FIG. 2 is a view for illustrating the shape of a coil incorporated in the fixing device 57.

As shown in FIG. 2, the fixing device 57 inserts copy paper P which is a to-be-fixed material holding a toner image T in between a heating (fixing) roller 59 and pressure (press) roller 60 and feeds the same. The heating roller 59 is driven in a direction indicated by an arrow by a driving motor (not shown). The pressure roller 60 is driven to follow rotation of the heating roller 59 and rotated in a direction indicated by an arrow.

For example, the heating roller 59 is an iron cylinder with a wall thickness of 1 mm, that is, an endless member having a metal layer formed of a conductor and a parting layer of Teflon or the like is formed on the surface thereof. Further, the heating roller 59 can be formed of stainless steel, aluminum, an alloy of stainless steel and aluminum or the like.

The pressure roller 60 is formed by coating a resilient material such as silicone rubber, fluorine rubber or the like around a metal core. The heating roller 59 and pressure roller 60 are pressed against each other by preset pressure by use of a pressure mechanism (not shown). Therefore, a nipper 101 with preset width is formed in a position in which the heating roller 59 and pressure roller 60 are pressed against each other. The nipper 101 is a portion of the outer surface of the pressure roller 60 which is pressed against the heating roller 59 and resiliently deformed. When the copy paper P passes the nipper 101, toner on the copy paper P is melted and fixed on the copy paper P.

Around the heating roller 59, a separation claw 102, cleaning member 103, parting agent coating device 104, thermistors 107*a*, 107*b*, 107*c* and thermostat 108 are arranged.

The separation claw 102 is disposed around the heating roller 59 and on the downstream side in the rotation direction from the nipper 101. The separation claw 102 is used to separate the copy paper P from the heating roller 59. The cleaning member 103 removes toner which is transferred onto the offset position of the outer surface of the heating roller 59, paper dust caused by the copy paper P and the like. The parting agent coating device 104 coats a parting agent which is used to prevent toner from being attached to the heating roller on the outer surface of the heating roller 59. The thermistors 107*a*, 107*b*, 107*c* detect temperatures of respective portions of the outer surface of the heating roller 59. The thermostat 108 opens the contact to interrupt supply of the power supply voltage when the detected temperature becomes higher than a preset temperature.

Inside the heating roller 59, three induction heaters (IH) 58*a*, 58*b*, 58*c* are disposed. On each induction heater 58 (58*a*, 58*b*, 58*c*), an exciter coil 105 (105*a*, 105*b*, 105*c*) used as magnetic field generating means configured by a litz wire formed by binding a plurality of insulated copper wires with a diameter of 0.5 mm, for example, is mounted. Since the exciter coil 105 is configured by a litz wire, the line diameter thereof can be made smaller than the penetration depth so as to permit a high-frequency current to flow effectively.

The exciter coil 105 is supported by a coil supporting member 106 formed of heat resistant resin (for example, heat resistant industrial plastic). The coil supporting member 106 is positioned between the heating roller 59 and a structural body (sheet metal) (not shown) which supports the heating roller 59.

The exciter coil 105 generates magnetic flux and eddy current in the heating roller 59 so as to prevent a variation in the magnetic field caused by the magnetic flux generated by the high-frequency current from an exciting circuit (inverter circuit) (not shown). Joule heat is generated by the eddy current and the inherent resistance of the heating roller 59 to heat the heating roller 59.

Next, the control system of the digital copying machine 1 is explained.

Figure 3:
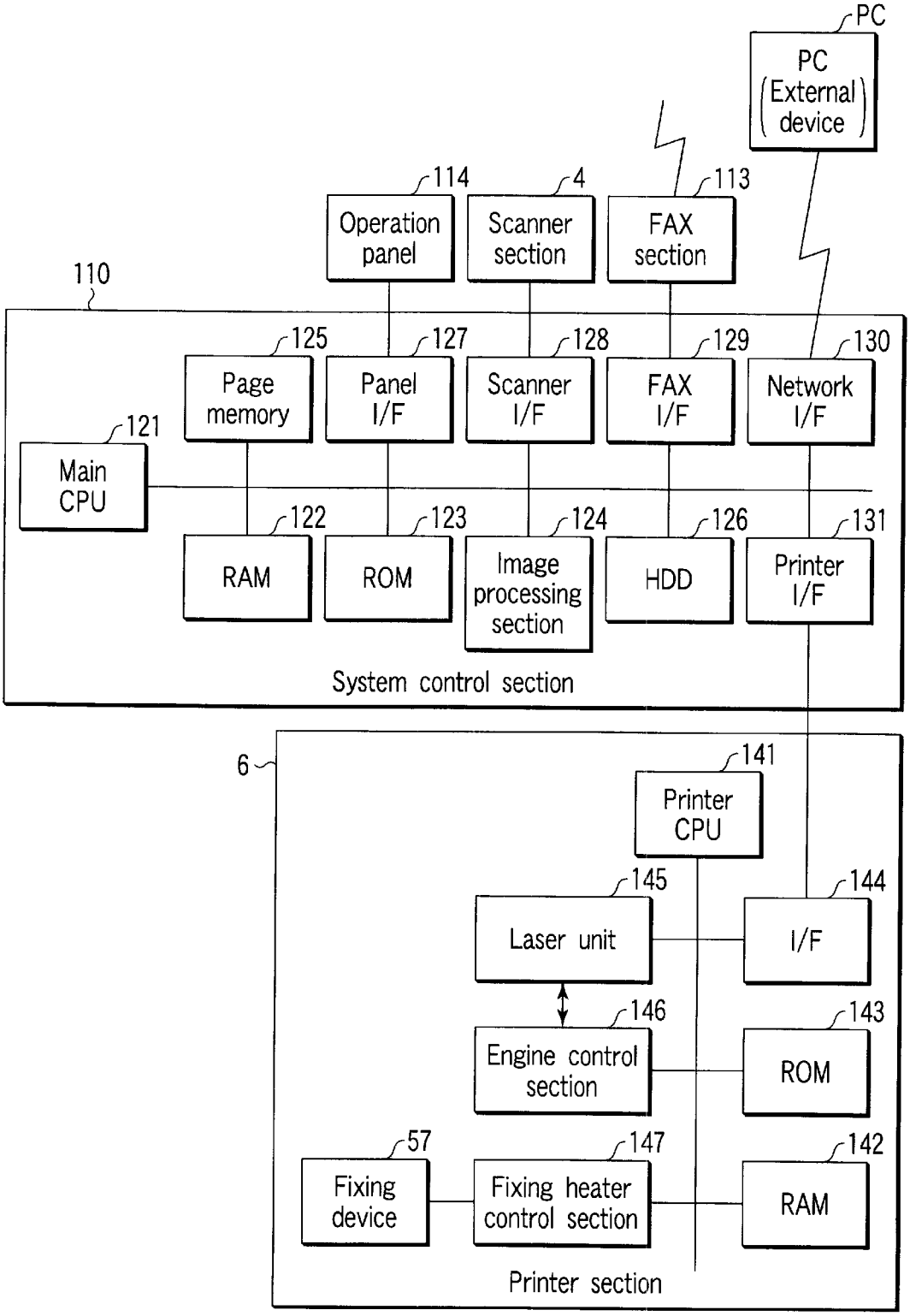
FIG. 3 is a diagram showing the internal configuration of a control circuit of the digital copying machine.

FIG. 3 is a diagram showing the internal configuration of a control circuit of the digital copying machine 1.

The digital copying machine 1 includes a system control section 110, scanner section 4, printer section 6, facsimile (FAX) section 113 and operation panel 114. The system control section 110 controls the whole portion of the digital copying machine. The FAX section 113 performs facsimile communication via a public communication line. The operation panel 114 is provided on the upper front portion of the apparatus main body 2 and used by the user to input specification of the operation or display guidance such as operation guidance for the user.

Although not shown in the drawing, the system control section 110 includes a main CPU 121 which controls the operation thereof, RAM 122, ROM 123, image processing section 124, page memory 125, HDD 126, panel interface (I/F) 127, scanner interface (I/F) 128, FAX interface (I/F) 129, network interface (I/F) 130 and printer interface (I/F) 131.

The main CPU 121 controls the whole portion of the system control section 110. The RAM (random access memory) 122 temporarily stores image data and data obtained in the operation. The ROM (read only memory) 123 stores software used to operate the digital copying machine 1.

The image processing section 124 processes an image input from an external device such as a PC or the scanner section 4, FAX section 113. Further, the image processing section 124 processes image data from the page memory 125, HDD 125 and outputs processed image data to the page memory 125, printer section 6 or HDD 126.

Further, the image processing section 124 includes a compression/expansion circuit (not shown). The image processing section 124 uses the compression/expansion circuit to compress image data from the page memory 125 or expands image data from the HDD 126.

The page memory 125 is a memory which stores image data from the image processing section 124 in page units. The HDD (hard disk drive) 126 is an external storage device of large capacity which stores image data compressed by the image processing section 124 and various data items. For example, when a plurality of copies are taken, a plurality of pages of image data compressed by the image processing section 124 are stored in the HDD 126. Compressed image data in the HDD 126 is read out under the control of the main CPU 121 at the time of printing.

The panel interface 127 is an interface which receives/transmits data with respect to the operation panel 114. The scanner interface 128 is an interface which receives/transmits data with respect to the scanner section 4. The FAX interface 129 is an interface which performs data communication with respect to the FAX section 113. The network interface 130 is an interface which performs data communication with respect to an external device such as a PC connected thereto via the network. The printer interface 131 is an interface which receives/transmits data with respect to the printer section 6.

Further, as shown in FIG. 3, the printer section 6 includes a printer CPU 141, RAM 142, ROM 143, interface (I/F) 144, laser unit 145, engine control board 146 and fixing heater control board 147.

The printer CPU 141 controls the whole portion of the printer section 6. The RAM 142 is a memory which temporarily stores data. The ROM 143 is a memory which stores a control program and the like. The interface 144 is an interface which receives/transmits data with respect to the system control section 110. The laser unit 145 controls the operation of the laser exposure device 28. A control circuit which controls driving of the photosensitive drum 30 and feeding rollers is mounted on the engine control board 146. The laser unit 145 and engine control board 146 transfer data with respect to each other under the control of the printer CPU 141 to perform the synchronous driving control operation. The fixing heater control board 147 is connected to the fixing device 57 and a control circuit which controls the temperature of the heating roller 59 is mounted on the fixing heater control board 147.

Next, the configuration of the heating roller 59 is explained.

Figure 4:
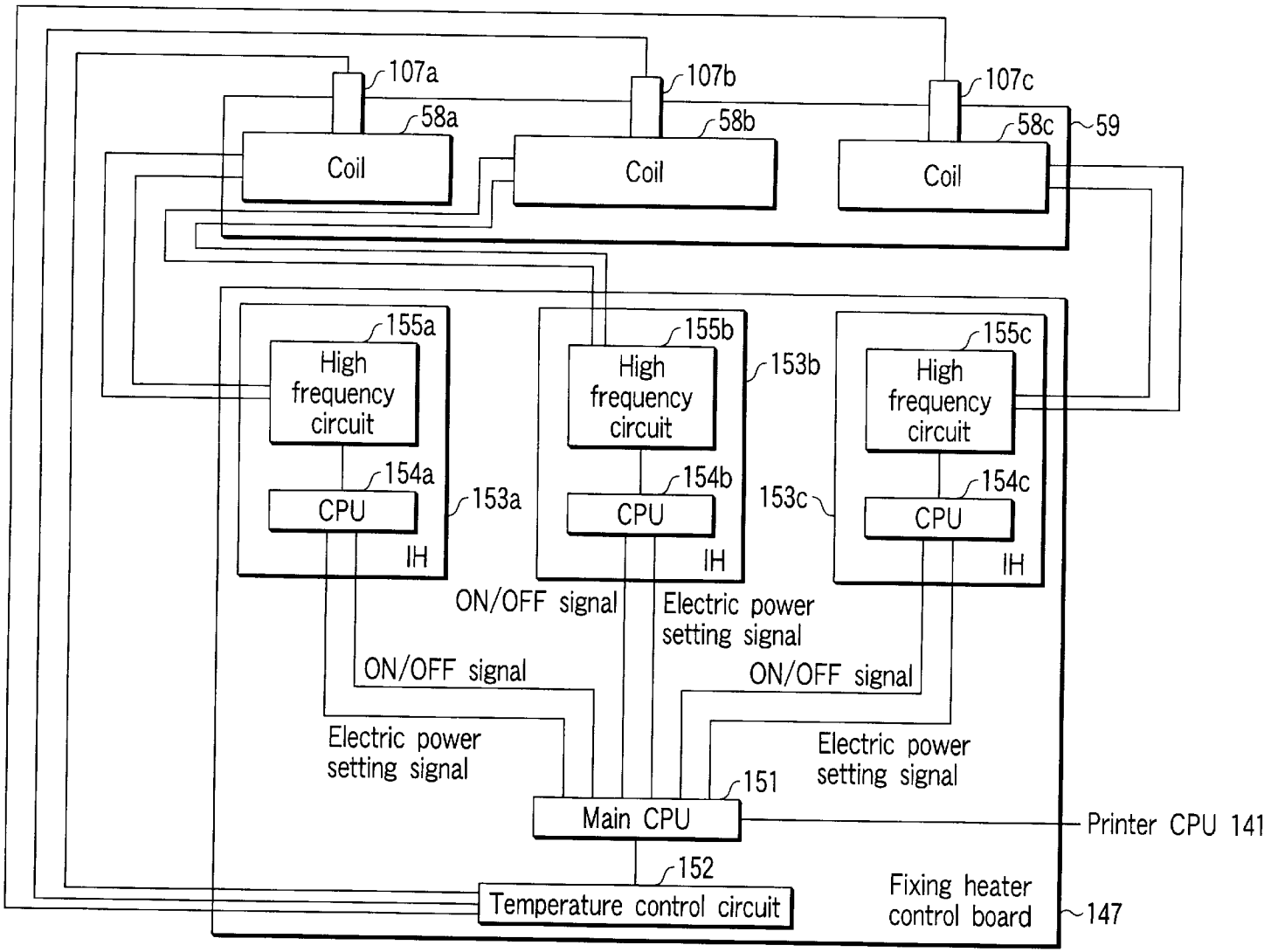
FIG. 4 is a diagram showing an example of the configuration of a heating roller.

FIG. 4 is a diagram showing an example of the configuration of the heating roller 59 and a control circuit which controls the temperature of the heating roller 59.

As shown in FIG. 4, the fixing heater control board 147 includes a main CPU 151, temperature control circuit 152 and induction heater control circuits (IH control circuits) 153*a*, 153*b*, 153*c*.

The main CPU 151 supplies control signals to the IH control circuits 153*a*, 153*b*, 153*c* based on information from the temperature control circuit 152 and printer CPU 141. The main CPU 151 supplies ON/OFF signals and power setting signals to the IH control circuits 153*a*, 153*b*, 153*c*.

The temperature control circuit 152 is supplied with detection signals from temperature detection thermistors 107*a*, 107*b*, 107*c* provided in positions corresponding to the set positions of the respective coils. The temperature control circuit 152 transmits temperatures of portions of the heating roller 59 which lie near the coils 58*a*, 58*b*, 58*c* based on the detection signals from the respective thermistors.

The IH control circuits 153*a*, 153*b*, 153*c*are circuits which set the ON/OFF states and amounts of electric power of the respective coils 58*a*, 58*b*, 58*c*. The IH control circuits 153*a*, 153*b*, 153*c*respectively include CPUs 15*a*, 15*b*, 15*c* and high-frequency circuits 155*a*, 155*b*, 155*c*. The CPUs 15*a*, 15*b*, 15*c* respectively control the high-frequency circuits 155*a*, 155*b*, 155*c* based on the ON/OFF signals and power setting signals from the main CPU 151. The high-frequency circuits 155*a*, 155*b*, 155*c* cause power sources (not shown) to generate high-frequency signals and apply the same to the respective coils under the control of the respective CPUs.

When high-frequency currents are supplied from the high-frequency circuits 155*a*, 155*b*, 155*c* to the coils 58*a*, 58*b*, 58*c*, the coils 58*a*, 58*b*, 58*c* generate high-frequency magnetic fields. Eddy currents are generated in the heating roller 59 by the high-frequency magnetic fields and the heating roller 59 generates heat by itself based on eddy current losses due to the eddy currents and the resistance of the heating roller 59.

Next, an image area of image data is explained.

The system control section 110 is supplied with image data from an external device such as a PC or the scanner section 4 or facsimile section via the corresponding interface. The main CPU 121 is designed to determine an image area of input image data. The image area of the image data is determined based on the set positions of the coils 58*a*, 58*b*, 58*c* in the heating roller 59.

In the following explanation, the coil 58*b* is used as a center heater 58*b*, and the coils 58*a*, 58*c* are used as side heaters 58*a*, 58*c*. The image area of the image data is determined to be a center area C corresponding to the center heater 58*b* or side areas S1, S2 corresponding to the side heaters 58*a*, 58*c*.

Figure 5:
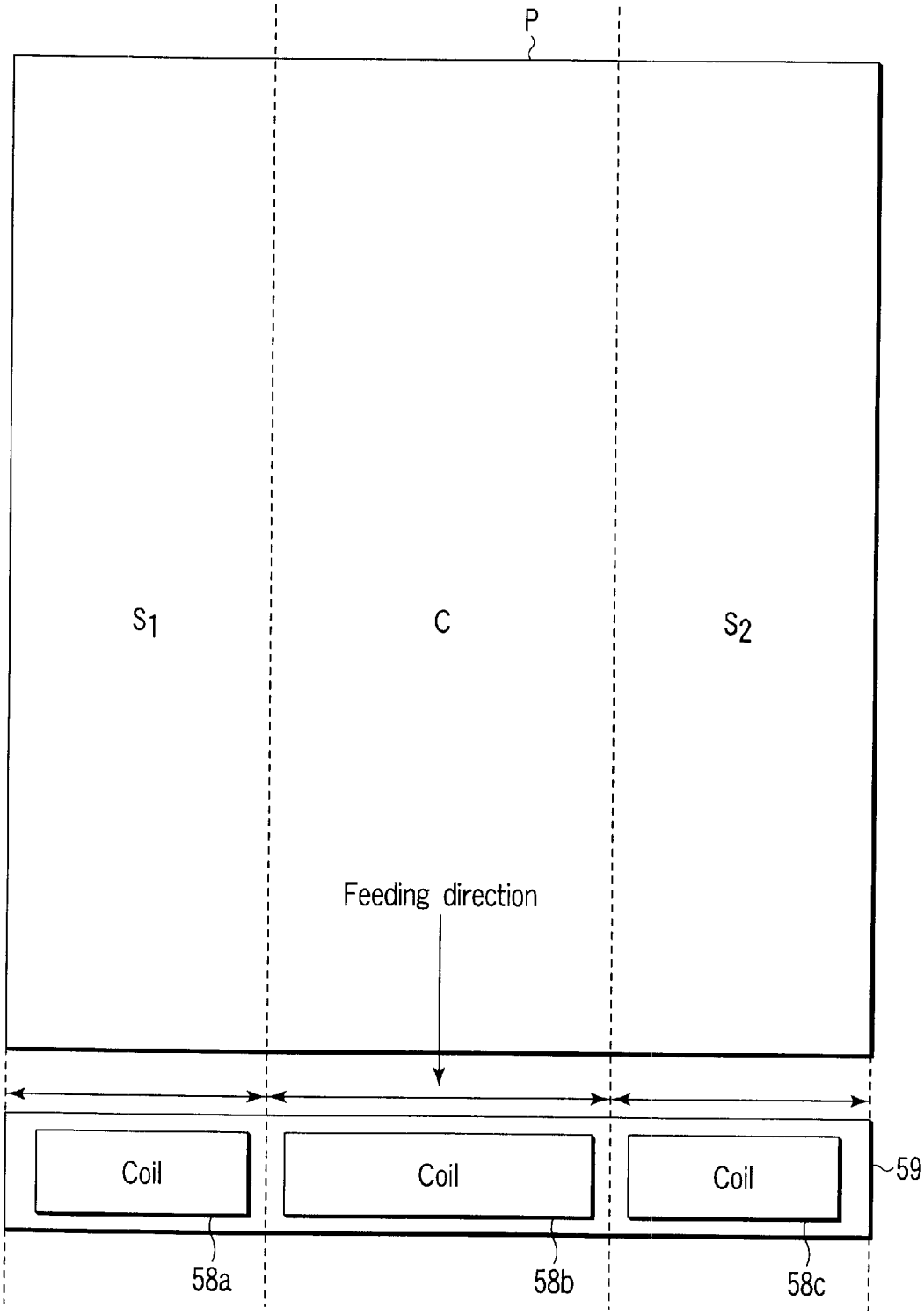
FIG. 5 is a diagram for illustrating an image area of image data.

FIG. 5 is a diagram for illustrating the image area of image data.

As shown in FIG. 5, when copy paper P having an image transferred thereon passes the heating roller 59, the image is subjected to the fixing process by heat. Therefore, no problem occurs in the printing result even if no heat is applied to a portion of the paper which has no image (pixels) formed thereon.

In the fixing device 57 with the above configuration, a plurality of heaters (coils) 58*a*, 58*b*, 58*c* are used as heat sources of the heating roller 59. For example, if pixels exist only in the center area C on the paper (if no pixels are present in the side areas S1 and S2), the process for fixing the image onto the paper can be performed only by energizing the center heater 58*b*. Further, if pixels are present only in the side area S1 or S2 on the paper (if no pixels are present in the center area C), the process for fixing the image onto the paper can be performed only by energizing the side heater 58*a*, or 58*c*.

As described above, if the heating roller 59 is heated by use of a plurality of heat sources, the heaters are divided into heaters which are required to be energized and heaters which are not required to be energized according to areas on the paper in which pixels exist. Conventionally, the whole portion of the heating roller is ON/OFF-controlled irrespective of an area in which pixels are present. In this case, since energy such as electric power is also supplied to the heater which is not required to be energized, energy is used unnecessarily.

On the other hand, in the system control section 110, when image data is input or image data is output to the printer section, the presence or absence of pixels (actual image) in the respective areas previously set in correspondence to the heaters is checked. The control operation for the respective heaters at the time of printing operation is determined based on the result of checking.

For example, the system control section 110 sets the center area and side areas based on the feeding direction of copy paper onto which image data is transferred and determines whether or not pixels (actual image) of an amount larger than a preset amount are present in each of the areas. It is determined in the above determining process that an image exists in an area in which a preset amount of or more pixels are present and no image is present in an area in which a preset amount of or less pixels are present. By performing the above image data checking process, it becomes possible to determine the presence or absence of an image in each area.

The preset amount of pixels used to determine the presence or absence of an image in each area may be previously set or may be changed according to a mode. For example, a mode in which the quality is preferentially considered and a mode in which power saving is preferentially considered are previously set. The presence or absence of an image in each area is determined according to a first preset amount which is set on the small side in the mode in which the quality is preferentially considered and the presence or absence of an image in each area is determined according to a second preset amount which is set larger than the first preset amount in the mode in which the power saving is preferentially considered. Thus, setting of the preset amounts can be made according to the requirement of the user.

Further, the presence or absence of an image in each area may be determined according to a histogram indicating the pixel distribution of image data with respect to the feeding direction of the paper. In this case, the system control section 110 creates a density histogram of image data with respect to the paper feeding direction, determines the presence of an image if the density is higher than a preset threshold value and determines the absence of an image if the density is lower than the preset threshold value.

Generally, pixels may exist in a portion of image data in which an actual image does not exist due to the influence of noise or the like in some cases. Pixels caused by noise will mostly disappear by performing the image process, but pixels caused by noise will remain in an image which is not subjected to the image process. For this reason, in the above explanation, the presence of an image is determined when a preset amount of or more pixels are present in the area. It is also possible to determine the presence or absence of an image according to the presence or absence of pixels in the area with respect to an image such as an image obtained after the image process is performed or print data supplied from an external device such as a PC in which pixels caused by noise are not practically present.

Now, assume that the user places a document on the document table 8 and specifies start of the copying process by use of the operation panel 114. If the copy start is specified by the user, the main CPU 121 of the system control section 110 causes the scanner section 4 to start to read the document. An image read by the scanner section 4 is input to the system control section 110.

In the system control section 110, image data of one page input via the scanner interface 128 is stored in the page memory 125. If one page of the image data is stored in the page memory 125, the main CPU 121 determines the presence or absence of an image in each area. The main CPU 121 notifies the printer section 6 of the presence or absence of an image in each area together with the image data. As a result, the printer section 6 can perform the efficient image forming operation free from a waste based on the area in which the image exists.

Further, when an image is input from the facsimile section 113 or image data is input from an external device connected via the network interface 130, the presence or absence of an image in each area is checked with respect to the input image data to control the respective heaters in the same manner as described above.

First, second, third and fourth operation examples are explained as control examples of the heaters.

First, the first operation example is explained.

The first operation example indicates a case wherein the side heaters 58*a*, 58*c* and center heater 58*b* are ON/OFF-controlled according to an area in which an image exists at the time of normal operation of the digital copying machine.

Figure 6:
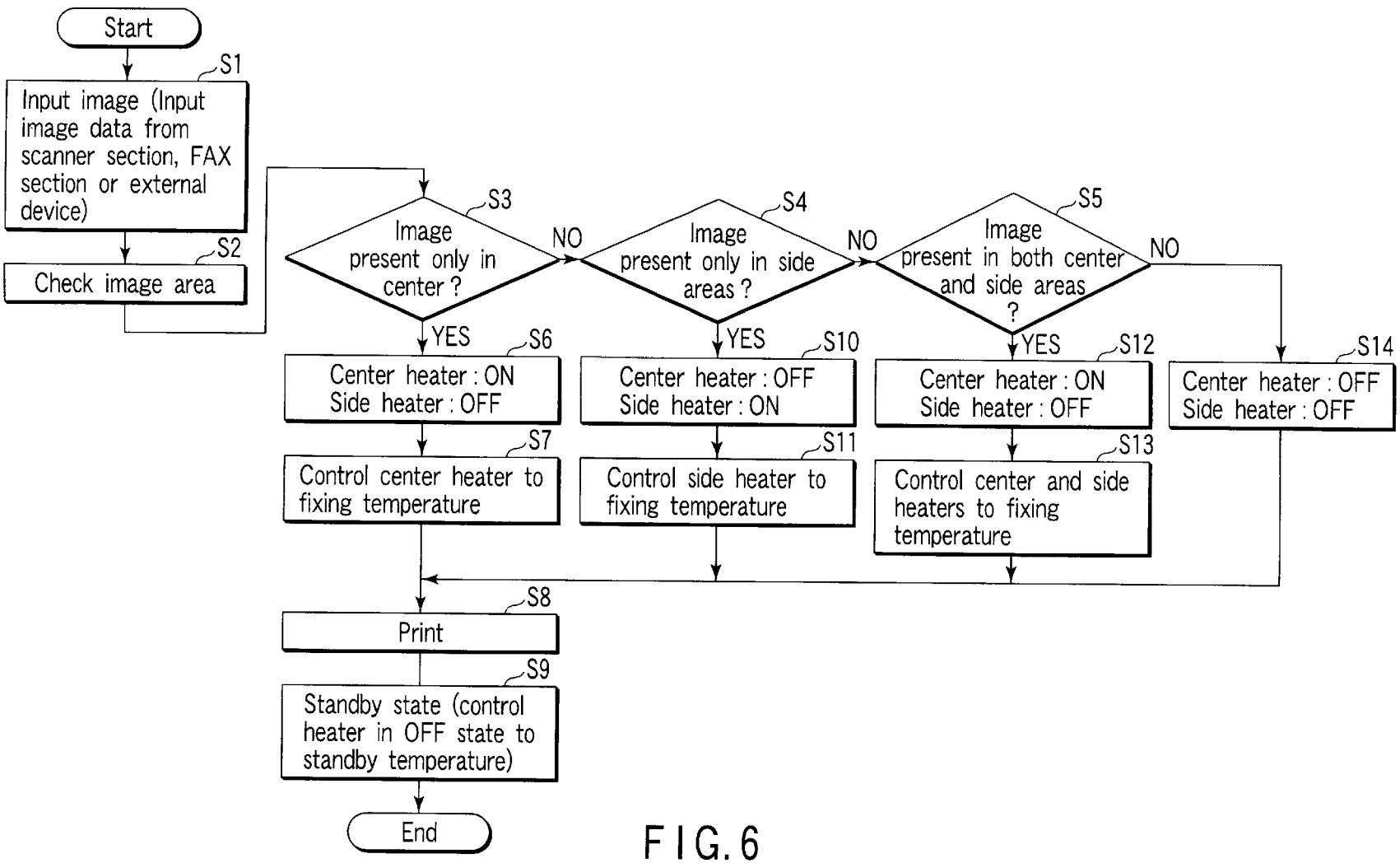
FIG. 6 is a flowchart for illustrating an example of the first operation.

FIG. 6 is a flowchart for illustrating an operation example of the normal operation.

First, assume that the digital copying machine is set in a normal standby state in which the copying operation can be immediately performed. If image data is input in this state (step S1), the main CPU 121 checks an input image area (step S2). In the image area checking process, the main CPU 121 determines the presence or absence of an image in each of the center area C and side areas S1, S2 which are divided based on the positional relation between the position of an image to be transferred onto the paper and the center heater 58*b* and side heaters 58*a*, 58*c* (steps S3 to S5).

That is, the main CPU 121 determines whether an image is present only in the center area C (step S3), an image is present only in at least one of the side areas S1 and S2 (step S4), or an image is present in both of the center area C and the side area S1, S2 (step S5).

In this case, if the main CPU 121 determines that the image is present only in the center area C ("YES" in step S3), the main CPU 121 determines that only the center heater 58*b* is to be set in the ON state and the side heaters 58*a*, 58*c* are to be set in the OFF state. Based on the above determination, the printer CPU 141 causes the fixing heater control section 147 to turn ON only the center heater 58*b* (step S6).

If only the center heater 58*b* is turned ON, the printer CPU 141 determines whether or not the surface temperature of a portion of the heating roller 59 which corresponds to the center heater 58*b* has reached a preset fixing temperature based on the detection result of the thermistor 107*b* (step S7). If it is determined in the above determination process that the preset fixing temperature is reached, the printer CPU 141 performs the operation for printing an image supplied from the system control section 110 on paper (step S8).

After the printing operation is terminated, the printer CPU 141 controls the center heater 58*b* and side heaters 58*a*, 58*c* to set the temperature of the whole portion of the heating roller 59 to a temperature of the normal standby state. As a result, the digital copying machine is set into the normal standby state (step S9).

If the main CPU 121 determines that the image is present only in at least one of the side areas S1, S2 ("YES" in step S4), the main CPU 121 determines that only the side heaters 58*a*, 58*c* are to be set in the ON state and the center heater 58*b* is to be set in the OFF state. Based on the above determination, the printer CPU 141 causes the fixing heater control section 147 to turn ON only the side heaters 58*a*, 58*c* (step S10).

If only the side heaters 58*a*, 58*c* are turned ON, the printer CPU 141 determines whether or not the surface temperatures of portions of the heating roller 59 which correspond to the side heaters 58*a*, 58*c* have reached a preset fixing temperature based on the detection results of the thermistors 107*a*, 107*c* (step S11). If it is determined in the above determination process that the preset fixing temperature is reached, the printer CPU 141 performs the operation for printing an image supplied from the system control section 110 on paper (step S8).

After the printing operation is terminated, the printer CPU 141 controls the center heater 58*b* and side heaters 58*a*, 58*c* to set the temperature of the whole portion of the heating roller 59 to a temperature of the normal standby state. As a result, the digital copying machine is set into the normal standby state (step S9).

Further, if the main CPU 121 determines that the image is present in both of the center area C and side areas S1, S2 ("YES" in step S5), the main CPU 121 determines that the center heater 58*b* and the side heaters 58*a*, 58*c* are to be all set in the ON state.

Based on the above determination, the printer CPU 141 causes the fixing heater control section 147 to turn ON all of the center heater 58*b* and side heaters 58*a*, 58*c* (step S12).

If all of the heaters 58*a*, 58*b*, 58*c* are turned ON, the printer CPU 141 determines whether or not the surface temperature of the whole portion of the heating roller 59 has reached a preset fixing temperature based on the detection results of the thermistors 107*a*, 107*b*, 107*c* (step S13). If it is determined in the above determination process that the preset fixing temperature is reached, the printer CPU 141 performs the operation for printing an image supplied from the system control section 110 on paper (step S8).

After the printing operation is terminated, the printer CPU 141 controls the center heater 58*b* and side heaters 58*a*, 58*c* to set the temperature of the whole portion of the heating roller 59 to a temperature of the normal standby state. As a result, the digital copying machine is set into the normal standby state (step S9).

If the main CPU 121 determines that an image is present in neither the center area C nor the side area S1, S2 ("NO" in step S5), the main CPU 121 determines that the center heater 58*b* and side heaters 58*a*, 58*c* are to be all set in the OFF state. Based on the above determination, the printer CPU 141 causes the fixing heater control section 147 to turn OFF all of the center heater 58*b* and side heaters 58*a*, 58*c* (step S14).

In this state, the printer CPU 141 feeds copy paper taken out from the cassette to the paper discharging port as the printing operation for a sheet of blank paper, that is, as the operation for printing no image on the copy paper (step S8). After the above operation is terminated, the printer CPU 141 controls the center heater 58*b* and side heaters 58*a*, 58*c* to set the temperature of the whole portion of the heating roller 59 to a temperature of the normal standby state. As a result, the digital copying machine is set into the normal standby state (step S9).

As described above, if printing image data is input in the normal standby state (waiting state for copying), an area in which an image among the input image data is actually present is determined and only the heater among a plurality of heaters which is required to be energized for the fixing process is turned ON based on the above determination result. Thus, electric power supplied to the heater which is not required for the fixing process is reduced and electric power can be prevented from being consumed unnecessarily.

Next, the second operation example is explained.

In the second operation example, the operation performed when a printing image is input while the digital copying machine is set in a preheating (low power) mode or sleep mode is explained. The preheating mode is to make an amount of electric power supplied to the fixing device smaller than an amount of electric power supplied thereto in the normal standby state. The preheating mode is released in response to a start signal of the printing operation and changed into a normal operation mode to start the printing operation. The sleep mode is to cut off supply of electric power to the fixing device. The sleep mode is released in response to an input operation of a preset key of the operation panel or a control signal from the exterior and changed into a normal operation mode.

Figure 7:
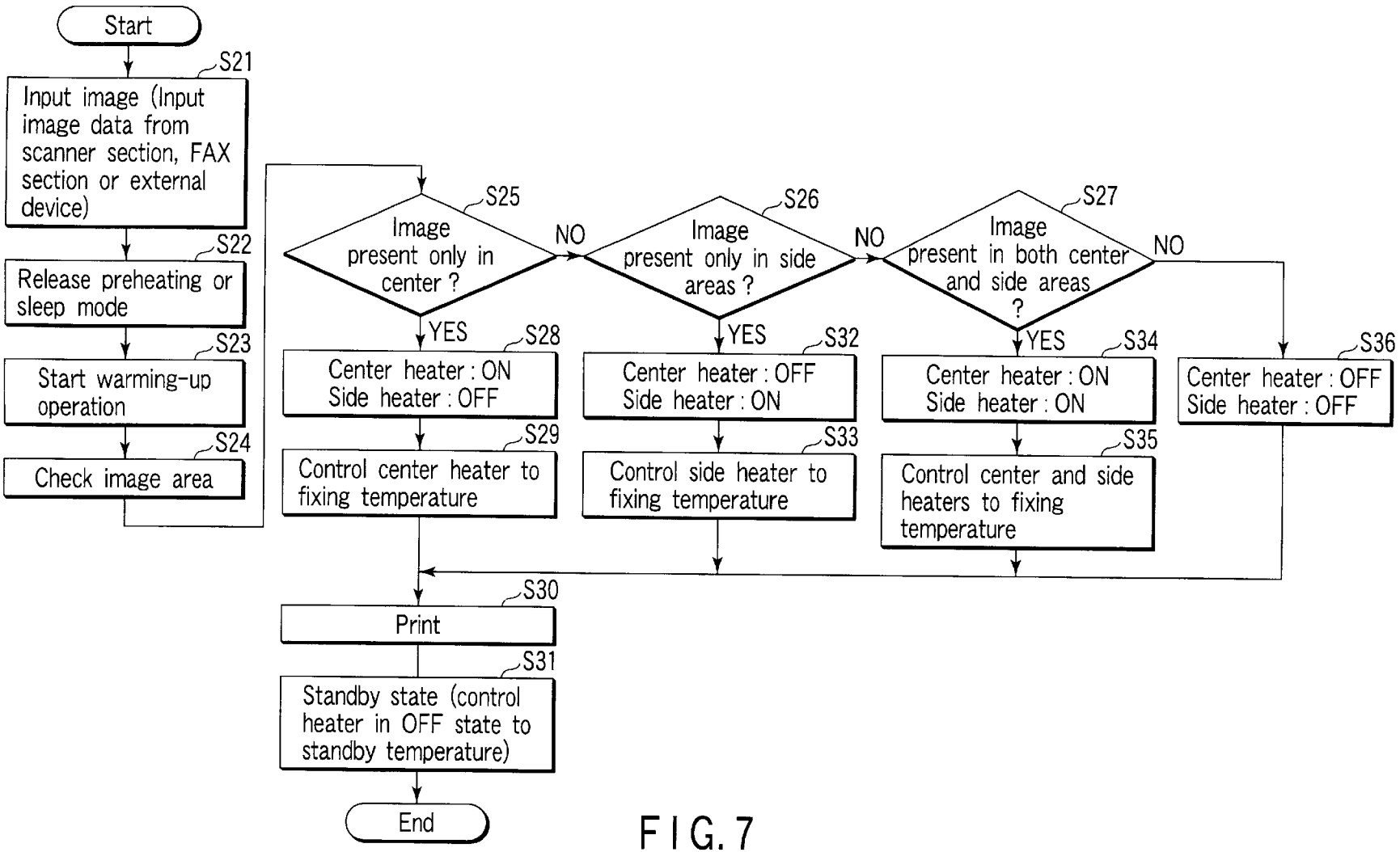
FIG. 7 is a flowchart for illustrating an example of the second operation.

FIG. 7 is a flowchart for illustrating an example of the operation in the preheating mode or sleep mode.

First, assume that the digital copying machine is set in the preheating mode or sleep mode. In this state, if image data starts to be input to the system control section 110 (step S21), the main CPU 121 releases the preheating mode or sleep mode (step S22). If the preheating mode or sleep mode is released, the main CPU 121 starts the normal warming-up operation (step S23).

The warming-up operation is an operation for heating the whole portion of the heating roller 59 to a preset fixing temperature. Further, if the heat source of the heating roller is an IH, a problem that resonance occurs when the adjacent coils are simultaneously energized occurs. If a plurality of IHs are used as the heat source in order to solve the above problem, adjacent coils are alternately energized or the adjacent coils are energized with the outputs thereof lowered in the warming-up operation. Therefore, in the fixing device using a plurality of IHs as the heat source, it takes a long time to perform the normal warming-up operation in some cases.

Further, if the image data is input to the system control section 110, the main CPU 121 checks an image area based on the input image data (step S24). In the image area checking process, the main CPU 121 determines the presence or absence of an image in each of the center area C and side areas S1, S2 with respect to the input image data (steps S25 to S27). As shown in FIG. 5, the center area C and side areas S1, S2 are areas which are divided based on the positional relation between the position of an image to be transferred onto the paper and the center heater 58*b* and side heaters 58*a*, 58*c*.

That is, the main CPU 121 determines whether an image is present only in the center area C (step S25), an image is present only in at least one of the side areas S1 and S2 (step S26), or an image is present in both of the center area C and the side area S1, S2 (step S27).

In this case, if the main CPU 121 determines that the image is present only in the center area C ("YES" in step S25), the main CPU 121 determines that only the center heater 58*b* is to be set in the ON state and the side heaters 58*a*, 58*c* are to be set in the OFF state. At this time, if the warming-up operation is not yet completed, the printer CPU 141 causes the fixing heater control section 147 to turn ON the center heater 58*b* and turn OFF the side heaters 58*a*, 58*c* based on the above determination (step S28) without waiting for completion of the warming-up operation.

If the center heater 58*b* is turned ON and the side heaters 58*a*, 58*c* are turned OFF, the printer CPU 141 determines whether or not the surface temperature of a portion of the heating roller 59 corresponding to the center heater 58*b* has reached a preset fixing temperature based on the detection result of the thermistor 107*b* (step S29). If it is determined in the above determination process that the preset fixing temperature is reached, the printer CPU 141 performs the operation for printing an image supplied from the system control section 110 on paper (step S30).

After the printing operation is terminated, the printer CPU 141 controls the center heater 58*b* and side heaters 58*a*, 58*c* to set the temperature of the whole portion of the heating roller 59 to a temperature in the normal standby state. As a result, the digital copying machine is set into the normal standby state (step S31).

If the main CPU 121 determines that the image is present only in at least one of the side areas S1, S2 ("YES" in step S26), the main CPU 121 determines that only the side heaters 58*a*, 58*c* are to be set in the ON state and the center heater 58*b* is to be set in the OFF state. At this time, if the warming-up operation is not yet completed, the printer CPU 141 causes the fixing heater control section 147 to turn ON the side heaters 58*a*, 58*c* and turn OFF the center heater 58*b* based on the above determination (step S32) without waiting for completion of the warming-up operation.

If the side heaters 58*a*, 58*c* are turned ON and the center heater 58*b* is turned OFF, the printer CPU 141 determines whether or not the surface temperatures of portions of the heating roller 59 which correspond to the side heaters 58*a*, 58*c* have reached a preset fixing temperature based on the detection results of the thermistors 107*a*, 107*c* (step S33). If it is determined in the above determination process that the preset fixing temperature is reached, the printer CPU 141 performs the operation for printing an image supplied from the system control section 110 on paper (step S30).

After the printing operation is terminated, the printer CPU 141 controls the center heater 58*b* and side heaters 58*a*, 58*c* to set the temperature of the whole portion of the heating roller 59 to a temperature in the normal standby state. As a result, the digital copying machine is set into the normal standby state (step S31).

Further, if the main CPU 121 determines that the image is present in both of the center area C and side areas S1, S2 ("YES" in step S27), the main CPU 121 determines that the center heater 58*b* and the side heaters 58*a*, 58*c* are to be all set in the ON state. At this time, if the warming-up operation is not yet completed, the printer CPU 141 maintains the warming-up operation. As a result, the printer CPU 141 causes the fixing heater control section 147 to turn ON all of the center heater 58*b* and side heaters 58*a*, 58*c* based on the above determination (step S34).

When the warming-up operation is continuously performed, the printer CPU 141 determines whether or not the surface temperature of the whole portion of the heating roller 59 has reached a preset fixing temperature based on the detection results of the thermistors 107*a*, 107*b*, 107*c* (step S35). If it is determined by the above determination process that the preset fixing temperature is reached (the warming-up operation is completed), the printer CPU 141 performs the operation for printing an image supplied from the system control section 110 on paper (step S30).

After the printing operation is terminated, the printer CPU 141 controls the center heater 58*b* and side heaters 58*a*, 58*c* to set the temperature of the whole portion of the heating roller 59 to a temperature in the normal standby state. As a result, the digital copying machine is set into the normal standby state (step S31).

If the main CPU 121 determines that an image is present in neither the center area C nor the side area S1, S2 ("NO" in step S27), the main CPU 121 determines that the center heater 58*b* and side heaters 58*a*, 58*c* are to be all set in the OFF state. At this time, if the warming-up operation is not yet completed, the printer CPU 141 causes the fixing heater control section 147 to turn OFF all of the center heater 58*b* and side heaters 58*a*, 58*c* based on the above determination (step S36) without waiting for completion of the warming-up operation.

In a state in which all of the center heater 58*b* and side heaters 58*a*, 58*c* are all set in the OFF state, the printer CPU 141 feeds copy paper taken out from the cassette to the paper discharging port as the printing operation for a sheet of blank paper (step S30). After the above operation is terminated, the printer CPU 141 controls the center heater 58*b* and side heaters 58*a*, 58*c* to set the temperature of the whole portion of the heating roller 59 to a temperature of the normal standby state. As a result, the digital copying machine is set into the normal standby state (step S31).

As described above, according to the second operation example, if image data for printing is input in the standby state in a power saving mode such as a preheating mode or sleep mode, an area in which an image among the input image data is actually present is determined and only the heater among a plurality of heaters which is required to be energized for the fixing process is turned ON based on the above determination result without waiting for completion of the warming-up operation. Thus, electric power supplied to the heater which is not required for the fixing process can be reduced, electric power can be prevented from being consumed unnecessarily and the warming-up time can be reduced.

In the first and second operation examples, the digital copying machine is set into the standby state by controlling the heaters to be set to the normal standby temperature after the printing operation is terminated, but it is also possible to perform the temperature control operation for the heaters to keep the present state. In this case, if image data next input has similar image areas, the effect of reducing time required for raising the temperatures of the heaters to preset temperatures can be obtained.

Next, a third operation example is explained.

The third operation example is to control amounts of electric power supplied to the side heaters 58*a*, 58*c* and center heater 58*b* according to areas in which an image is present at the time of the normal operation of the digital copying machine.

In the third operation example, in addition to the operation which is similar to the operation in the first operation example, the heaters are not only ON/OFF-controlled, but also amounts of electric power supplied to the heaters are controlled. That is, in the third operation example, a large amount of electric power (for example, 900 W) is supplied to the heater corresponding to an area in which an image exists so that the temperature thereof will rapidly reach the preset fixing temperature and a small amount of electric power (for example, 300 W) is supplied to the heater corresponding to an area in which no image exists.

Figure 8:
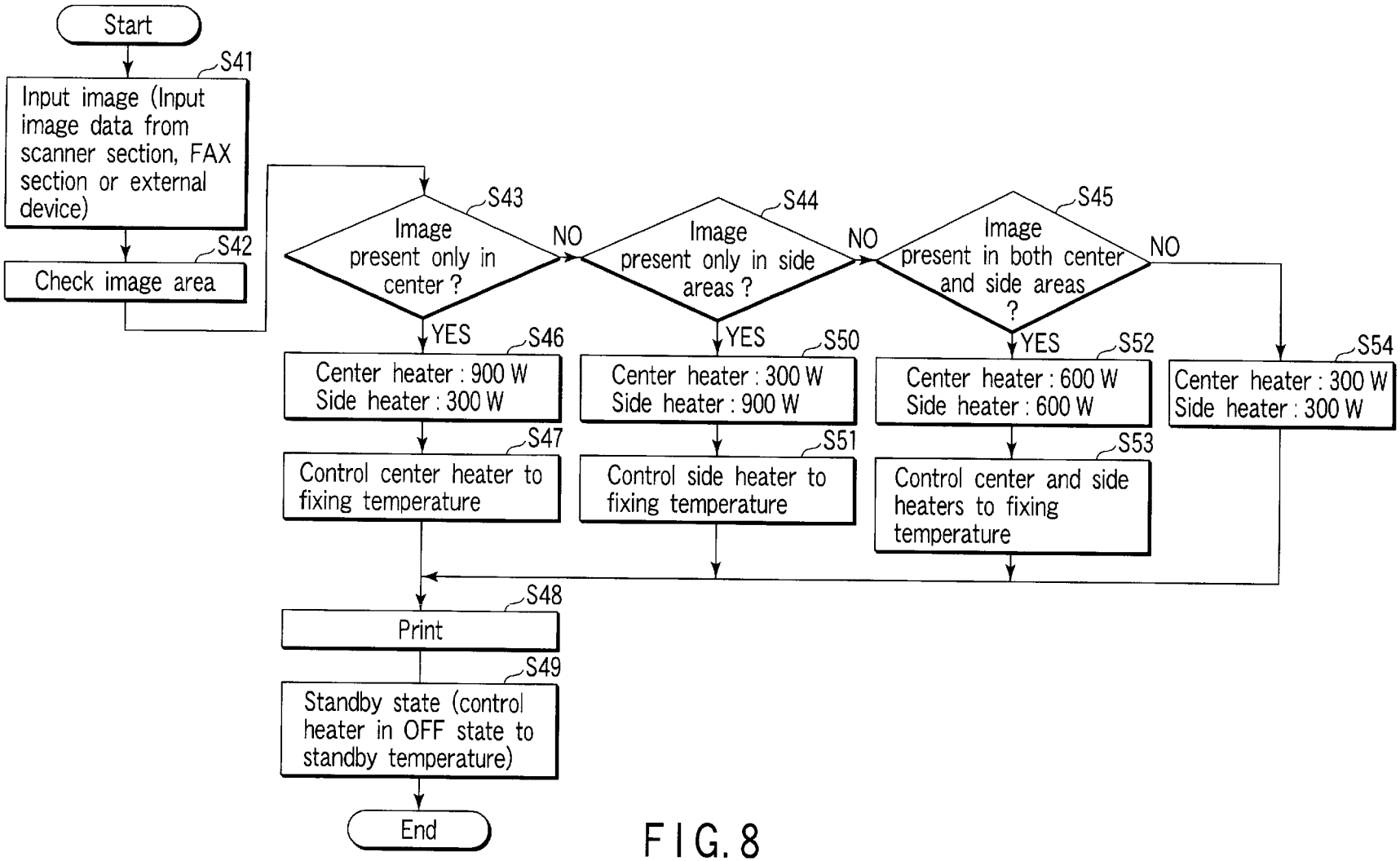
FIG. 8 is a flowchart for illustrating an example of the third operation.

FIG. 8 is a flowchart for illustrating the third operation example.

As shown in FIG. 8, only steps S46, S50, S52, S54 among the steps S41 to S54 corresponding to steps S1 to S14 are different.

If it is determined that an image is present only in the center area C ("YES" in step S43), the main CPU 121 determines in step S46 that the electric power to be supplied to the center heater 58*b* is 900 W and the electric power to be supplied to the side heaters 58*a*, 58*c* is 300 W. Based on the above determination, the printer CPU 141 causes the fixing heater control section 147 to supply electric power of 900 W to the center heater 58*b* and supply electric power of 300 W to the side heaters 58*a*, 58*c* (step S46).

Thus, the printer CPU 141 performs the printing operation (step S48) when the surface temperature of a portion of the heating roller 59 corresponding in position to the center heater 58*b* has reached a preset fixing temperature based on the detection result of the thermistor 107*b* (step S47).

If it is determined that an image is present only in at least one of the side areas S1, S2 ("YES" in step S44), the main CPU 121 determines in the step S50 that electric power to be supplied to the side heaters 58*a*, 58*c* is 900 W and electric power to be supplied to the center heater 58*b* is 300 W. Based on the above determination, the printer CPU 141 causes the fixing heater control section 147 to supply electric power of 900 W to the side heaters 58*a*, 58*c* and supply electric power of 300 W to the center heater 58*b* (step S50).

Thus, the printer CPU 141 performs the printing operation (step S48) when the surface temperatures of portions of the heating roller 59 corresponding in position to the side heaters 58*a*, 58*c* have reached a preset fixing temperature based on the detection results of the thermistors 107*a*, 107*c* (step S51).

Further, if it is determined that an image is present in both of the center area C and side areas S1, S2 ("YES" in step S45), the main CPU 121 determines in step S52 that the electric power to be supplied to all of the center heater 58*b* and side heaters 58*a*, 58*c* is 600 W. Based on the above determination, the printer CPU 141 causes the fixing heater control section 147 to supply electric power of 600 W to all of the center heater 58*b* and side heaters 58*a*, 58*c* (step S52).

In this case, it is necessary to heat the whole portion of the heating roller 59. Therefore, in order to uniformly heat the whole portion of the heating roller 59, electric power of 600 W is supplied to each heater as a constant amount of electric power. If the amount of power consumption of the digital copying machine or fixing device is sufficiently large, the amount of electric power supplied to each heater may be 900 W.

Thus, the printer CPU 141 performs the printing operation (step S48) when the surface temperature of the whole portion of the heating roller 59 has reached a preset fixing temperature based on the detection results of the thermistors 107*a*, 107*b*, 107*c* (step S53).

If it is determined that no image is present in the center area C and the side area S1, S2 ("NO" in step S45), the main CPU 121 determines in step S54 that the electric power to be supplied to each of the center heater 58*b* and side heaters 58*a*, 58*c* is 300 W. Based on the above determination, the printer CPU 141 causes the fixing heater control section 147 to supply electric power of 300 W to all of the center heater 58*b* and side heaters 58*a*, 58*c* (step S54).

In this state, the printer CPU 141 feeds copy paper taken out from the cassette to the paper discharging section as the printing operation for a sheet of blank paper (step S48).

As described above, according to the third operation example, if printing image data is input in the normal standby state (waiting state for copying), an area in which an image among the input image data is actually present is determined and the amounts of electric power supplied to the heaters are controlled based on the above determination result. Thus, electric power supplied to the heater which is not required for the fixing process is reduced and electric power can be prevented from being consumed unnecessarily.

Next, a fourth operation example is explained.

Like the second operation example, in the fourth operation example, the operation performed when a printing image is input while the digital copying machine is set in a preheating (low power) mode or sleep mode is explained.

In the fourth operation example, in addition to the operation which is similar to the operation in the second operation example, the heaters are not only ON/OFF-controlled, but also the amounts of electric power supplied to the heaters are controlled. That is, in the fourth operation example, a large amount of electric power (for example, 900 W) is supplied to the heater corresponding to an area in which an image exists so that the temperature thereof will rapidly reach the preset fixing temperature and a small amount of electric power (for example, 300 W) is supplied to the heater corresponding to an area in which no image exists.

Figure 9:
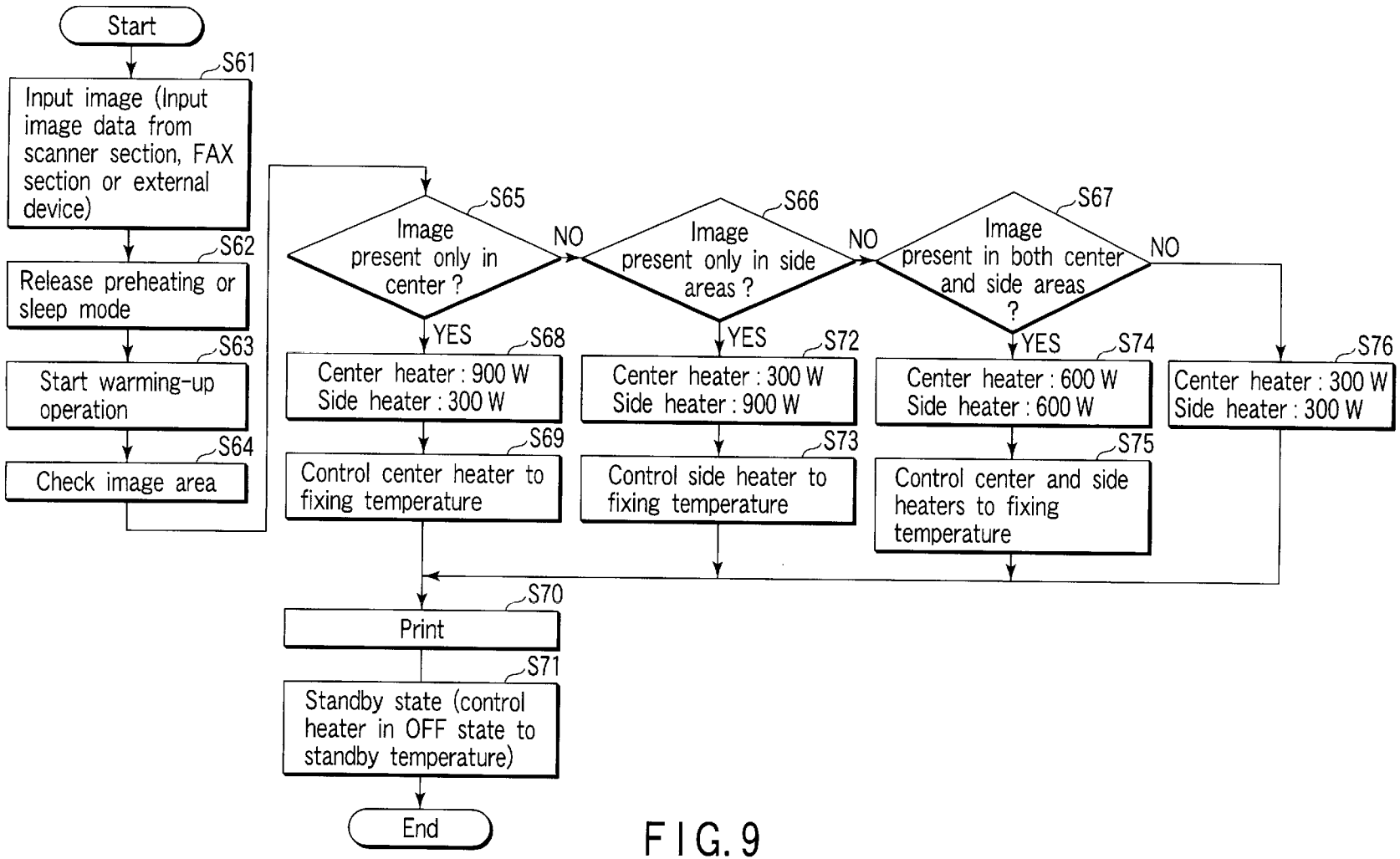
FIG. 9 is a flowchart for illustrating an example of the fourth operation.

FIG. 9 is a flowchart for illustrating the fourth operation example.

As shown in FIG. 9, only steps S68, S72, S74 and S76 among steps S61 to S76 corresponding to the steps S21 to S36 are different. Since steps S68, S72, S74 and S76 are the same as steps S46, S50, S52 and S54 in the third operation example, the detail explanation thereof is omitted.

As described above, according to the fourth operation example, if printing image data is input while the standby state is kept in the power saving mode such as the preheating mode or sleep mode, an area in which an image among the input image data is actually present is determined without waiting for completion of the warming-up operation and the amounts of electric power supplied to the respective heaters are controlled based on the result of determination. Thus, the amount of electric power supplied to the heater which is not required for the fixing process is reduced and useless consumption of electric power can be prevented and the warming-up time can be reduced.

The control operation for the heaters as in the first, second, third and fourth operation examples can be performed for every input image data of one page or for every image data of one copy unit containing a plurality of pages.

Further, in the above embodiment, an image is divided into the center area and side areas and the heaters divided into three portions are controlled as the two heaters of the center heater and side heater, but the three-divided heaters can be controlled in correspondence to three areas. For example, the three image areas S1, C, S2 shown in FIG. 5 are used as areas respectively corresponding to the heaters 58*a*, 58*b*, 58*c*. The ON/OFF state of each heater or an amount of electric power supplied to each heater is controlled according to the presence or absence of an image in each area. Thus, useless consumption of electric power can be prevented.

Further, in the above embodiment, the fixing device having three-divided coils as the heater in the heating roller is explained, but in a case where the heater in the heating roller is configured by three or more heaters, the same control operation as in the above embodiment can be attained by setting image areas in correspondence to the respective heaters. For example, if the heater is configured by four (five, six, seven, . . . ) heaters, four (five, six, seven, . . . ) image areas corresponding to the respective heaters are set. The presence or absence of an image in each area is determined and the ON/OFF state of each heater corresponding to each area or an amount of electric power supplied to each heater is controlled based on the result of determination. Thus, the heater can be precisely controlled according to the application of a print and the consumption of electric power can be reduced.

Further, in the above embodiment, the area is unconditionally set in one-to-one correspondence to each heater, but it is also possible to change the area corresponding to each heater according to the mode selected by the user. For example, a first mode in which an image of high quality is formed and a second mode in which an image is formed with less electric power are previously set. Then, in the first mode, each of the heaters is controlled according to the presence or absence of an image in a corresponding one of the areas previously set. Further, in the second mode, each of the areas previously set is expanded by an area to which the preheating temperature by the corresponding heater is transmitted, and if the range in which pixels of image data exist lies within the expanded area, it is determined that the image lies only in the above area and the heater control operation is performed based on the above determination result. Thus, the power saving or the quality of the printing result which is to be preferentially taken into consideration can be selected according to the requirement of the user.

The configuration of each heater is not limited to the IH and any heater having a plurality of heater elements which can be divided can be used, and in the above embodiment, a case wherein the IH is used as the heat source for heating the heating roller is explained. This is because time (rise time) from supply of the electric power to the IH until the surface of the heating roller reaches a preset temperature is short if the IH is used as the heat source.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device which fixes a to-be-fixed agent on an image-forming medium comprising:

a heat roller which has a plurality of heaters contained therein and corresponding portions of which are heated by selectively supplying electric power to the heaters, an image area determining section which determines whether a fixing process is necessary or not for each of areas corresponding to the portions of said heat roller which are selectively heated by the heaters based on an image to be fixed on the image-forming medium, and a fixing control section which supplies preset electric power only to the heater corresponding to the area which is determined to require the fixing process by said image area determining section to set the corresponding portion on the heat roller to a fixing temperature and fixes the to-be-fixed agent on the image-forming medium when the portion of the heat roller which corresponds to the heater supplied with the preset electric power has reached a preset fixing temperature.

2. The fixing device according to claim 1, wherein said plurality of heaters are induction heating devices.

3. The fixing device according to claim 1, wherein said fixing control section turns ON the heater corresponding to the area which is determined to require the fixing process and turns OFF the heater corresponding to the area which is not determined to require the fixing process.

4. The fixing device according to claim 1, wherein said fixing control section supplies electric power to the heater corresponding to the area which is determined to require the fixing process to set the corresponding portion of the heat roller to a preset fixing temperature and supplies electric power which is less than the electric power supplied to the heater corresponding to the area which is determined to require the fixing process to the heater corresponding to the area which is not determined to require the fixing process.

5. The fixing device according to claim 1, wherein said heat roller contains a center heater which heats a center portion thereof and side heaters which heat side portions thereof other than the center portion, said image area determining section determines the presence or absence of an image which requires the fixing process in an area corresponding to the center portion and the presence or absence of an image which requires the fixing process in areas corresponding to the side portions, and said fixing device turns ON the center heater and turns OFF the side heaters when it is determined that an image which requires the fixing process is present only in the center portion, turns OFF the center heater and turns ON the side heaters when it is determined that an image which requires the fixing process is present only in the side portions, turns ON the center heater and the side heaters when it is determined that an image which requires the fixing process is present in both of the center portion and side portions, and turns OFF the center heater and the side heaters when it is determined that an image which requires the fixing process is present in neither the center portion nor the side portions.

6. The fixing device according to claim 1, wherein said heat roller contains a center heater which heats a center portion thereof and side heaters which heat side portions thereof other than the center portion, said image area determining section determines the presence or absence of an image which requires the fixing process in an area corresponding to the center portion and the presence or absence of an image which requires the fixing process in areas corresponding to the side portions, and said fixing device supplies preset fixing control electric power to the center heater and supplies electric power less than the preset fixing control electric power to the side heaters when it is determined that an image which requires the fixing process is present only in the center portion, supplies electric power less than the preset fixing control electric power to the center heater and supplies the preset fixing control electric power to the side heaters when it is determined that an image which requires the fixing process is present only in the side portions, supplies preset fixing control electric power to the center heater and the side heaters when it is determined that an image which requires the fixing process is present in both of the center portion and side portions, and supplies electric power less than the preset fixing control electric power to the center heater and the side heaters when it is determined that an image which requires the fixing process is present in neither the center portion nor the side portions.

7. An image forming apparatus which forms an image on an image-forming medium by use of a developer comprising:

an image input section which inputs image data, an optical unit which applies light to an image carrier to expose the image carrier to light according to image data input by said image input section, a transferring section which transfers a developer image corresponding to an electrostatic latent image formed on the image carrier by applying light thereto by use of said optical unit onto the image-forming medium, a fixing device including a heat roller which has a plurality of heaters contained therein and corresponding portions of which are heated by selectively supplying electric power to the heaters, an image area determining section which determines whether a fixing process is necessary or not for each of areas corresponding to the portions of the heat roller respectively heated by the heaters based on image data input by said image input section, a heater control section which supplies preset electric power only to the heater corresponding to the area which is determined to require the fixing process by said image area determining section to set the corresponding portion of the heat roller to a fixing temperature, and a printing control section which feeds the image-forming medium having the developer image transferred thereon by said transferring section to the fixing device and fixes the to-be-fixed agent on the image-forming medium by use of the heat roller when the portion of the heat roller corresponding to the heater supplied with the electric power by said heater control section has reached a preset fixing temperature.

8. The image forming apparatus according to claim 7, wherein said plurality of heaters are induction heating devices.

9. The image forming apparatus according to claim 7, wherein said fixing control section turns ON the heater corresponding to the area which is determined to require the fixing process and turns OFF the heater corresponding to the area which is not determined to require the fixing process.

10. The image forming apparatus according to claim 7, wherein said fixing control section supplies electric power to the heater corresponding to the area which is determined to require the fixing process to set the corresponding portion of the heat roller to a preset fixing temperature and supplies electric power which is less than the electric power supplied to the heater corresponding to the area which is determined to require the fixing process to the heater corresponding to the area which is not determined to require the fixing process.

11. The image forming apparatus according to claim 7, wherein said image input section is a scanner which optically reads a document image and converts the read image into image data.

12. The image forming apparatus according to claim 7, wherein said image input section is a facsimile section which receives facsimile data from an external device via a telephone line.

13. The image forming apparatus according to claim 7, wherein said image input section is a network interface which receives print data from an external device connected thereto via a network.

14. The image forming apparatus according to claim 7, wherein said heater control section starts a warming-up operation to set the heat roller to a preset standby temperature if the heat roller is not set at the preset standby temperature when image data is input by said image input section, interrupts the warming-up operation when said image area determining section determines an area which requires the fixing process during the warming-up operation and supplies preset electric power only to the heater which corresponds to the area which is determined to require the fixing process by said image area determining section to set a corresponding portion of the heat roller to a fixing temperature.

15. The image forming apparatus according to claim 7, wherein said heat roller contains a center heater which heats a center portion thereof and side heaters which heat side portions thereof other than the center portion, said image area determining section determines the presence or absence of an image which requires the fixing process in an area corresponding to the center portion and the presence or absence of an image which requires the fixing process in areas corresponding to the side portions, and said fixing device turns ON the center heater and turns OFF the side heaters when it is determined that an image which requires the fixing process is present only in the center portion, turns OFF the center heater and turns ON the side heaters when it is determined that an image which requires the fixing process is present only in the side portions, turns ON the center heater and the side heaters when it is determined that an image which requires the fixing process is present in both of the center portion and side portions, and turns OFF the center heater and the side heaters when it is determined that an image which requires the fixing process is present in neither the center portion nor the side portions.

16. The image forming apparatus according to claim 7, wherein said heat roller contains a center heater which heats a center portion thereof and side heaters which heat side portions thereof other than the center portion, said image area determining section determines the presence or absence of an image which requires the fixing process in an area corresponding to the center portion and the presence or absence of an image which requires the fixing process in areas corresponding to the side portions, and said fixing device supplies preset fixing control electric power to the center heater and supplies electric power less than the preset fixing control electric power to the side heaters when it is determined that an image which requires the fixing process is present only in the center portion, supplies electric power less than the preset fixing control electric power to the center heater and supplies the preset fixing control electric power to the side heaters when it is determined that an image which requires the fixing process is present only in the side portions, supplies preset fixing control electric power to the center heater and the side heaters when it is determined that an image which requires the fixing process is present in both of the center portion and side portions, and supplies electric power less than the preset fixing control electric power to the center heater and the side heaters when it is determined that an image which requires the fixing process is present in neither the center portion nor the side portions.

17. A fixing device which fixes a to-be-fixed agent on an image-forming medium comprising:

heating means which has a plurality of heaters contained therein and corresponding portions of which are heated by selectively supplying electric power to the heaters, image area determining means for determining whether a fixing process is necessary or not for each of areas corresponding to the portions of said heating means which are selectively heated by the heaters based on an image to be fixed on the image-forming medium, and fixing control means for supplying preset electric power only to the heater corresponding to the area which is determined to require the fixing process by said image area determining means to set the corresponding portion of said heating means to a fixing temperature and fixes the to-be-fixed agent on the image-forming medium when the portion of said heating means corresponding to the heater supplied with the preset electric power has reached a preset fixing temperature.

18. An image forming apparatus which forms an image on an image-forming medium by use of a developer comprising:

image input means for inputting image data, optical control means for applying light to an image carrier to expose the image carrier to light according to image data input by said image input means, transferring means for transferring a developer image corresponding to an electrostatic latent image formed on the image carrier by applying light thereto by said optical control means onto the image-forming medium, fixing means including a heat roller which has a plurality of heaters contained therein and corresponding portions of which are heated by selectively supplying electric power to the heaters, image area determining means for determining whether a fixing process is necessary or not for each of areas corresponding to the portions of the heat roller which are selectively heated by the heaters based on image data input by said image input means, heater control means for supplying preset electric power only to the heater corresponding to the area which is determined to require the fixing process by said image area determining means to set the corresponding portion of the heat roller to a fixing temperature, and printing control means for feeding the image-forming medium having the developer image transferred thereon by said transferring means to the fixing means and fixing the to-be-fixed agent on the image-forming medium by use of the heat roller when the portion of the heat roller corresponding to the heater supplied with the electric power by said heater control means has reached a preset fixing temperature.

19. A fixing method used in a fixing device including a heat roller which has a plurality of heaters contained therein and corresponding portions of which are heated by selectively supplying electric power to the heaters comprising:

determining whether a fixing process is necessary or not for each of areas corresponding to the portions of the heat roller which are selectively heated by the heaters based on an image to be fixed on an image-forming medium, supplying preset electric power only to the heater corresponding to the area which is determined to require the fixing process by said determining step to set the corresponding portion of the heating means to a fixing temperature, and fixing the to-be-fixed agent on the image-forming medium when the portion of the heat roller corresponding to the heater supplied with the preset electric power has reached a preset fixing temperature.

20. An image forming method used in an image forming apparatus using a fixing device including a heat roller which has a plurality of heaters contained therein and corresponding portions of which are heated by selectively supplying electric power to the heaters comprising:

inputting image data, applying laser light to an image carrier to expose the image carrier to light according to the input image data, transferring a developer image corresponding to an electrostatic latent image formed on the image carrier onto the image-forming medium, determining whether a fixing process is necessary or not for each of areas corresponding to the portions of the heat roller respectively heated by the heaters based on the input image data, supplying preset electric power only to the heater corresponding to the area which is determined to require the fixing process by said determining step to set the corresponding portion of the heat roller to a fixing temperature, and feeding the image-forming medium having the developer image transferred thereon and fixing the to-be-fixed agent on the image-forming medium when the portion of the heat roller corresponding to the heater supplied with electric power has reached a preset fixing temperature.

* * * * *